US008437949B2

(12) United States Patent
Weitz et al.

(10) Patent No.: US 8,437,949 B2
(45) Date of Patent: May 7, 2013

(54) METHOD AND SYSTEMS FOR DETERMINING REQUIRED INTERVAL MANAGEMENT PERFORMANCE (RIMP)

(75) Inventors: Lesley A. Weitz, Arlington, VA (US); Ian Levitt, New Gretna, NJ (US)

(73) Assignee: The MITRE Corporation, McLean, VA (US)

( * ) Notice: Subject to any disclaimer, the term of this patent is extended or adjusted under 35 U.S.C. 154(b) by 231 days.

(21) Appl. No.: 13/070,185

(22) Filed: Mar. 23, 2011

(65) Prior Publication Data

US 2012/0245835 A1 Sep. 27, 2012

(51) Int. Cl.
*G06G 7/76* (2006.01)

(52) U.S. Cl.
USPC ..... 701/120

(58) Field of Classification Search ..... 701/120
See application file for complete search history.

(56) References Cited

U.S. PATENT DOCUMENTS 6,885,313 B2 4/2005 Selk, II et al.
7,693,620 B2 * 4/2010 Dubeck et al. ..... 701/16
8,027,756 B2 * 9/2011 Davis et al. ..... 701/8
8,060,295 B2 * 11/2011 Estkowski et al. ..... 701/120
2003/0004619 A1 * 1/2003 Carriker et al. ..... 701/3
2012/0191332 A1 * 7/2012 Sawhill et al. ..... 701/120
2012/0191333 A1 * 7/2012 Sawhill et al. ..... 701/122

OTHER PUBLICATIONS

Haraldsdottir et al., "Terminal Area Management Concepts Using Tactical Merge Management Techniques," *Digital Avionics Systems Conference (DASC)*, 2010 IEEE/AIAA 29th, vol., No., pp. 1.E.3-1-1.E.3-12, Oct. 3-7, 2010.

* cited by examiner

*Primary Examiner* — Thomas Tarcza
*Assistant Examiner* — Alex C Dunn
(74) *Attorney, Agent, or Firm* — Sterne, Kessler, Goldstein & Fox P.L.L.C.

(57) ABSTRACT

A method of characterizing an airborne spacing operation is provided. The method includes determining, using a computer, a spacing tolerance based on a performance objective for the spacing operation, determining, using a computer, a minimum state data level and a minimum speed performance level based on the spacing tolerance, determining, using a computer, an airborne functionality required to meet the performance objective, and providing, using a computer, a required interval management performance (RIMP) category for the airborne spacing operation, the RIMP category specifying the spacing tolerance, the minimum state data level, the minimum speed performance level, and the airborne functionality.

26 Claims, 7 Drawing Sheets

100

METHOD AND SYSTEMS FOR DETERMINING REQUIRED INTERVAL MANAGEMENT PERFORMANCE (RIMP)

STATEMENT REGARDING FEDERALLY-SPONSORED RESEARCH AND DEVELOPMENT

Statement under M.P.E.P. §310. The U.S. government has a paid-up license in this invention and the right in limited circumstances to require the patent owner to license others on reasonable terms as provided for by the terms of Contract DTFAWA-10-C-0080 awarded by the Federal Aviation Administration (FAA).

Part of the work performed during development of this invention utilized U.S. Government funds. The U.S. Government has certain rights in this invention.

BACKGROUND

1. Field

The present invention generally relates to airborne spacing between an aircraft and a target aircraft.

2. Background

Several efforts have been undertaken to improve the efficiency of the National Airspace System (NAS). For example, Traffic Flow Management (TFM) concepts that better utilize NAS resources when controllers are managing traffic flows have been explored. Moreover, Time-Based Flow Management, which broadly describes the use of trajectory prediction on the ground to determine Estimated Times of Arrival (ETAs) and the ability of aircraft to more precisely fly their trajectories determined by the Flight Management System (FMS) to meet Scheduled Times of Arrival (STAs) throughout the NAS, has also been explored.

Improving the efficiency of operations in the terminal area has received particular attention. Reducing the variability of inter-aircraft spacing in the terminal area leads directly to increases in throughput. Decision support tools that aid the controller in sequencing, merging, and spacing aircraft—and the flight-deck avionics that support the flight crew in the same tasks—are thus being explored to provide this reduction while also reducing controller workload. The division of capability and responsibility for sequencing, merging, and spacing tasks between ground-based and flight-deck-based systems is important and has been the topic of studies in the past. Spacing accuracy has improved when controller tools are supplemented with aircraft equipped with avionics that aid in spacing.

Research into airborne spacing concepts, which use flight-deck avionics to manage the spacing relative to another aircraft, has been ongoing for several decades. EUROCONTROL and NASA Langley Research Center, for example, have evaluated airborne spacing concepts for terminal area spacing in fast-time simulation environments, human-in-the-loop studies, and field testing. Additionally, United Parcel Service has certified and field tested avionics for airborne spacing in their arrival operations at Louisville International Airport.

The concept of Interval Management (IM) has been developed by the Federal Aviation Administration (FAA) for near-term implementation supporting NextGen. IM provides precise timing within the airborne traffic flow by managing the relative spacing interval between a target aircraft (lead) and an IM (trail) aircraft, and thus increases the efficiency of a variety of air traffic operations.

The IM system includes an airborne component and a ground component. The airborne component of the IM system, namely the Flight-deck Interval Management (FIM), includes avionics onboard the IM aircraft, called the FIM equipment. The FIM equipment provides longitudinal speed guidance in an effort to achieve and/or maintain a desired spacing interval relative to a target aircraft assigned by the air traffic controller. A speed control algorithm in the FIM equipment determines the speeds of the IM aircraft as a function of IM and target aircraft states (e.g., horizontal position, vertical position, and horizontal velocity) and possibly other information about the environment. The IM aircraft is equipped with FIM equipment, and thus is capable of participating in IM operations. The ground component of IM, namely the Ground-based Interval Management (GIM), makes use of prediction tools on the ground, as well as the increased precision provided by FIM, to efficiently manage the spacing interval between aircraft within multiple environments and operations. In addition, GIM assists controllers in setting up the FIM operation by providing speed updates to meter aircraft to a point where the FIM operation begins. A facilitator of the IM concept is the expected widespread deployment of ADS-B Out and ADS-B In.

The precise spacing made possible by FIM, and managed by GIM, can facilitate IM operations with varying performance objectives, such as managing a schedule across sectors, enabling Optimized Profile Descents (OPDs), increasing throughput to a runway, and metering to a departure fix. An IM operation, as described herein, is an instance of an IM aircraft coupled to a target aircraft maintaining or achieving a desired spacing behind the target. For example, an IM operation can take place on departure, at arrival, or during en-route flight. IM operations are also referred to herein as "airborne spacing" operations.

IM operations are unified in concept and procedural design, but the scope of environments and operational contexts in which benefits are expected may result in functional performance characteristics that result in the needed performance and capabilities of the FIM equipment varying across the range of IM operations. Initial analysis of a set of near-term IM operations demonstrates that these performance differences exist.

BRIEF SUMMARY

Methods, systems, and computer program products relating to characterizing airborne spacing operations are provided. For example, in an embodiment, a method of characterizing an airborne spacing operation includes determining, using a computer, a spacing tolerance based on a performance objective for the spacing operation, determining, using a computer, a minimum state data performance level based on the spacing tolerance and the required integrity, determining, using a computer, a minimum speed performance level based on the spacing tolerance, determining, using a computer, an airborne functionality required to meet the performance objective, and providing, using a computer, a required interval management performance (RIMP) category for the airborne spacing operation, the RIMP category specifying the spacing tolerance, the minimum state data performance level, the minimum speed performance level, and the airborne functionality.

These and other advantages and features will become readily apparent in view of the following detailed description of the invention. Note that the Summary and Abstract sections may set forth one or more, but not all exemplary embodiments of the present invention as contemplated by the inventor(s).

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

Figure 1:
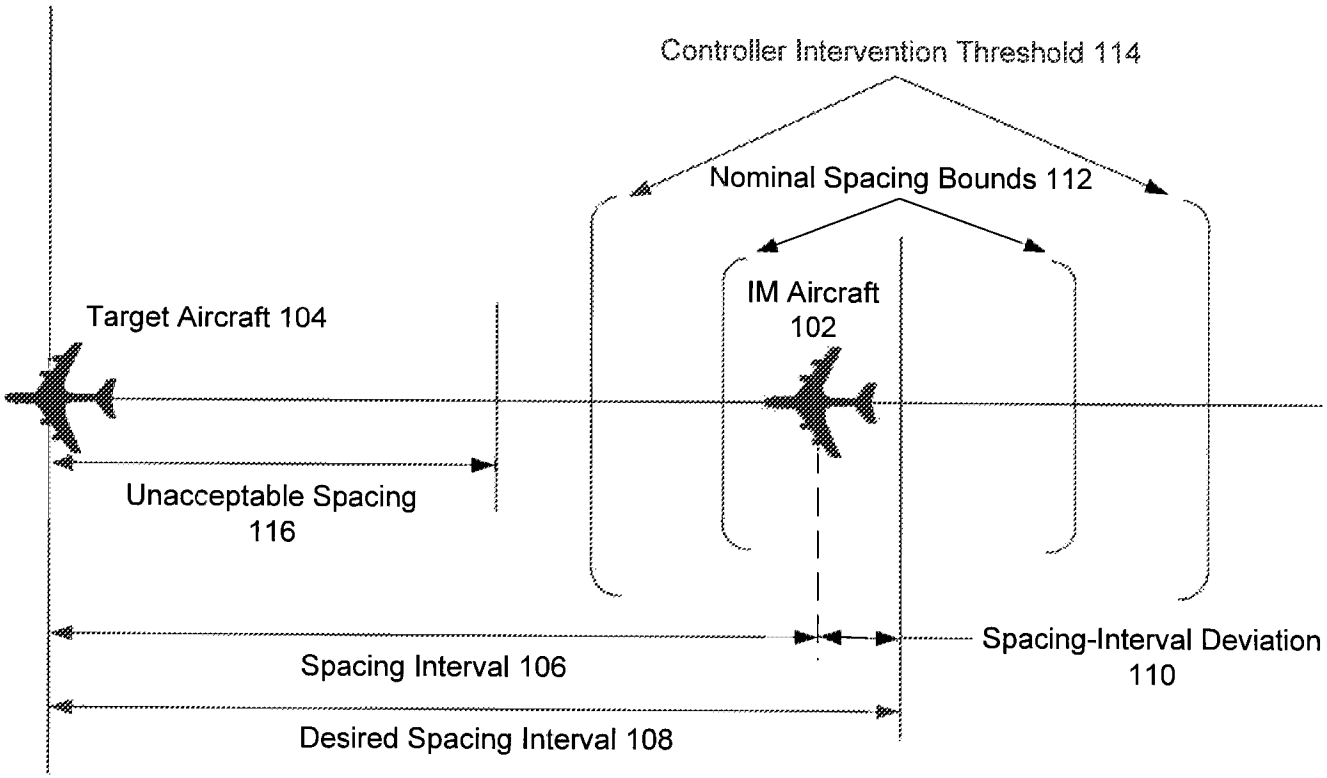
FIG. 1 illustrates a diagram including an IM aircraft and a target aircraft, according to an embodiment of the present invention.

The present invention will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

I. Introduction

To address the variation of needed performance and of the capabilities of the FIM equipment across different operations, a categorization scheme is provided, namely Required Interval Management Performance (RIMP), which characterizes a given airborne spacing operation. The RIMP categorization facilitates the development and management of IM operations in an airspace with varying performance objectives related to changing operational environments. A RIMP category can specify a variety of quantities relating to the IM operation. For example, and without limitation, the RIMP category can specify a spacing tolerance (also referred to herein as an "IM tolerance"), e.g., the longitudinal spacing accuracy needed to satisfy operational goals, and the performance and functional capabilities of the FIM equipment that ensure that the IM tolerance is met in the operating environment.

II. Overview

An IM operation requires a longitudinal spacing precision, termed an IM tolerance or a spacing tolerance, that satisfies its performance goal(s). In an embodiment, the performance goal or performance objective specifies a desired performance in a specified operating environment. The IM tolerance is derived from the ground perspective, and is a measure of the allowable deviation from the desired spacing interval. The magnitude of this deviation is based on what is needed to meet the performance objective, but is also determined so that the controller, with relatively limited information available on the progress of the IM operation as compared to the flight deck, trusts that the IM system is operating within nominal bounds. The IM tolerance can represent the 95% bounds on the fault-free spacing precision that is achieved and/or maintained by the IM aircraft through implementing the speeds determined by the FIM equipment. The fault-free spacing precision can be assumed to be modeled by a Gaussian distribution. However, as would be appreciated by those skilled in the art based on the description herein, other models for the fault-free spacing can be used without departing from the scope and spirit of the present invention.

The GIM component relies on the precision described by the IM tolerance to meet operational goals. The FIM equipment onboard the IM aircraft makes use of the IM tolerance to manage the spacing interval during the IM operation. As with other performance-based metrics, the analysis and framework that would be provided by RIMP ensures that the IM tolerance is met in the IM operation.

The IM tolerance and associated allocations of the IM tolerance to state data errors and to the performance of the speed control algorithm in the assumed operating environment can define the performance metrics for an IM operation and can be specified in the RIMP category. In addition, the level of FIM equipage can be variable, so the controller may need to differentiate IM aircraft according to functional capabilities (e.g., an ability to handle complex IM and target aircraft route geometries). For example, the level of FIM equipage can be specified in terms of the level of additional functionality needed relative to a baseline functionality. In one embodiment, the RIMP category includes a combination of discrete performance levels for each of the following four components:

- the IM tolerance to be met,
- the required performance of the state data,
- the required performance of the speed control algorithm in the assumed operating environment, and
- additional functional capabilities of the FIM equipment beyond those of the baseline equipment.

To meet the IM tolerance, a sufficiently high performance level of the state data is required by the speed control algorithm for calculating the speed commands. State data performance describes the accuracy of the IM and target aircraft state data (e.g., accuracy of the horizontal position, vertical position, and horizontal velocity measurements obtained through surveillance reports from the target aircraft and sensors onboard the IM aircraft), including latencies in the use of the state data and update intervals between surveillance reports from the target aircraft. Furthermore, the state data performance level can also include the integrity of the horizontal position, which describes an outer range of the possible horizontal position deviation during a given IM operation.

The speed control algorithm provides speed commands that correct deviations in the spacing interval so that the desired spacing interval is achieved and/or maintained within the IM tolerance in the assumed operating environment. The inventors have found that a few discrete performance levels defined for the state data and for the speed control algorithm may cover the needed performance of the spectrum of IM operations. Discrete values for the IM tolerance value included in the RIMP category can also be used.

Furthermore, certain IM operations may require the FIM equipment to have functional capabilities which may not be implemented in all instantiations of FIM equipment. For example, an IM operation may require the knowledge and use of final approach speeds, or to acquire and use complex route geometries for the IM and target aircraft. The RIMP category, and an IM aircraft's certification to support different RIMP categories, provides a way for the controller to manage functional differences in FIM equipage when conducting IM operations. Here again, a finite number of discrete levels of functional capabilities can be used to specify the functionality of the FIM equipage.

The RIMP category and associated analysis can be used in a number of ways. For example, some of the ways can include:

- the ground domain may use RIMP to categorize and manage IM operations. For example, RIMP provides a way to assign IM operations appropriately, and to easily adapt to changing environmental conditions or operational goals;
- pilots can use the RIMP category when initiating and conducting an IM operation and as part of their situation awareness;
- operational designers, in establishing the airspace and procedures for an IM operation, can work within the defined and available bounds provided by RIMP categories. The RIMP analysis can provide a direct relationship between bounds on the operating environment and fundamental operational objectives;
- avionics manufacturers can use the RIMP categories in the design of FIM equipment. Final categorization of the RIMP components establishes requirements on the FIM equipment that directly relate to the benefit provided by the supported IM operations; and
- certification authorities may use RIMP for operational approval of an IM operation and certification of the associated FIM equipment to be used.

Discrete performance levels associated with the IM tolerance, the state data performance, the speed control algorithm performance, and the functional capabilities can be used. These discrete performance levels can be systematically applied to the design and certification of future IM operations. In particular, IM operations designed after the approval of FIM equipment standards may use the RIMP categories and analysis to ensure that previously certified FIM equipment can be used to support new IM operations.

III. The Components of RIMP

A. Operationally-Required Tolerances

Operationally-required tolerances (ORTs) can be used to model the performance objectives for a given IM operation. Two quantities can make up the ORTs: (1) nominal spacing bounds and (2) a controller intervention threshold. Both of these quantities relate to bounds on the deviation from the desired spacing interval.

FIG. 1 shows a diagram 100 of an IM aircraft 102 and a target aircraft 104. As shown in FIG. 1, the spacing between IM aircraft 102 and target aircraft 104 is denoted by a spacing interval 106. Spacing interval 106 differs from a desired spacing interval 108 by a spacing-interval deviation 110. Deviation 110 is to be bounded by a pair of bounds: nominal spacing bounds 112 and a controller threshold 114. Both of the nominal spacing bounds 112 and controller threshold 114 are outside of the unacceptable spacing 116. Although performance curves defined by the nominal spacing bounds and the controller intervention threshold can be established independently, a single Gaussian distribution representing the nominal spacing performance in the assumed operating environment is determined to respect both constraints.

The nominal spacing bounds relate the performance objectives to a nominal spacing performance curve. In one non-limiting example, for simplicity, the nominal spacing bounds can be assumed to be described by a Gaussian distribution. The nominal spacing performance is the actual longitudinal spacing interval that is achieved and/or maintained in the presence of nominal state data errors and environmental effects. The mean and standard deviation of the performance curve can be chosen such that the deviation from the desired spacing interval meets the operational goals under fault-free conditions. Generally, faulted conditions correspond to the tails of the error probability distribution. Therefore, the standard deviation is specified by an observable bound, typically between 90% and 99.9%.

The controller intervention threshold is a theoretical threshold, which if crossed, will cause the controller to intervene in the IM operation. In one exemplary embodiment of spacing operations where controllers are monitoring for separation, in at least 99.9% of non-faulted IM operations, the deviations from the desired spacing interval do not exceed the bounds defined by the controller intervention threshold. For IM operations where an increased complexity demands greater controller trust in the IM aircraft's ability to negotiate the environment, a more stringent constraint on the likelihood of breaching the controller intervention threshold can be used. Extrapolating the nominal spacing performance to its 99.9% bound may demonstrate that the controller intervention threshold is respected under fault-free conditions. Alternatively, the controller intervention threshold may over-constrain nominal spacing performance and hence drive the IM tolerance. In high-complexity IM operations, monitoring or alerting functions in the FIM equipment can be configured to meet more stringent constraints or to mitigate off-nominal conditions.

B. Allocations of the IM Tolerance

Uncertainty in the actual states of the IM and target aircraft directly leads to reduced spacing precision. Similarly, increased uncertainty in the operating environment corresponds to increased deviation from the desired spacing interval. The IM tolerance is thus allocated to: 1) the performance of the IM and target aircraft state data and 2) the performance of the speed control algorithm in the assumed operating environment. These allocations provide top-down performance budgets for setting FIM equipment requirements, allowing the two effects to be managed independently.

In one embodiment, the allocation process can be iterative. For example, an initial conservative allocation is made to the most stressing and uncertain component, e.g., the speed control algorithm in the operating environment. The resulting allocation left for the state data performance is used as a top-down budget for that performance requirement. Any budget left after setting the state data performance can be reallocated to the speed performance in the environment.

1) IM Tolerance Allocation to State Data Performance

Uncertainties in the IM and target aircraft positions and velocities arising from latencies and measurement errors translate to errors in the calculated spacing interval that the IM aircraft is acting upon and, consequently, errors in the speeds calculated by the speed control algorithm in the FIM equipment. For example, and without limitation, a conservative model of the uncertainty in the spacing interval, relative to the desired spacing interval, as a result of errors in the state data has been established in RTCA Inc., "Safety, Performance, and Interoperability Requirements Document for Airborne Spacing-Flight Deck Interval Management (ASPA-FIM)," Tech. Rep. January 2011, FRAC Version ("RTCA"), which is incorporated by reference herein in its entirety. The model is independent of the particular implementation of speed control algorithm. From the top-down budget of the IM tolerance allocation to state data errors, requirements may be set on the individual parameters (e.g., horizontal position accuracy and horizontal velocity accuracy) that satisfy the allocation.

The application of this model to provide a measure of the spacing uncertainty attributable to state data errors depends only on the expected ground speeds of the IM aircraft. In RTCA, this model for state data errors was applied to an initial set of IM operations, and two discrete state data performance levels were found to be sufficient for the initial set of operations. These two performance levels may support many IM operations. In one embodiment, the first two performance levels differ only in horizontal position accuracy and horizontal velocity accuracy. In other embodiments, however, additional performance levels can arise and can further constrain other parameters, such as latencies or vertical position accuracy.

2) IM Tolerance Allocation to Speed Performance in the Assumed Operating Environment Operational uncertainties such as winds, turns, descents, and varying aircraft performance characteristics lead to deviations in the longitudinal spacing interval from the desired spacing interval. The fundamental concept behind FIM is the provision of speed commands derived by the speed control algorithm to counteract these environmental effects. As the environment increases in severity or complexity, it is expected that the performance of the speed control algorithm in the environment will be hampered resulting in a less precise spacing interval. In the same environment, a higher performing speed control algorithm will provide a more precise spacing interval. In this way, the assumed operating environment for an IM operation is related to the performance of the speed control algorithm, and an allocation of the IM tolerance is ascribed to this factor.

A set of discrete performance levels, each assigned to a respective speed control algorithm can be used. Higher performance levels can provide greater precision in the spacing in the presence of operational uncertainties. The performance levels can be differentiated by bounds on the closed-loop performance of the IM aircraft when following speeds determined by the speed control algorithm.

Whereas the allocation of the IM tolerance to the speed control algorithm performance in the assumed operating environment specifies the accuracy within which the spacing interval must be achieved and/or maintained, there are other considerations when specifying the speed performance levels. In some IM operations, strings of aircraft will be formed, where each IM aircraft is spacing relative to its preceding aircraft in the string while also acting as a target aircraft for its trailing aircraft in the string. When strings of IM aircraft are formed, a disturbance, arising from an operational uncertainty, to one IM aircraft may propagate along the string such that the deviations in the spacing intervals and the magnitudes of speed commands to correct these deviations increase along the string. Therefore, to provide efficient performance in these types of IM operations, the string performance of the speed control algorithm can also be considered when establishing the speed performance levels.

In reference RTCA and L. A. Weitz, "Investigating String Stability of a Time-History Control Law for Interval Management," in *Proceedings of the International Conference on Research in Air Transportation*, June 2010, which is incorporated by reference herein in its entirety, the closed-loop response of the IM aircraft to speed commands is related to a second-order system, which is parameterized by damping ratio and the aircraft's response to a new speed. Upper and lower bounds on these parameters can be used as a promising metric for the performance levels associated with the speed control algorithm, as they are easily testable and constrain the system both in terms of meeting the allocation of the IM tolerance and ensuring efficient string behavior.

Analysis has shown that acceptable string behavior can be achieved by increasing the damping ratio such that the system is over-damped, which limits the propagation of disturbances along the string. A lower bound ensures good string behavior, where IM aircraft cannot correct deviations in the spacing interval more quickly than the lower bound.

An upper bound prevents the IM aircraft from correcting deviations from the desired spacing interval too slowly. There can be two considerations in specifying an upper bound: the upper bound ensures that the desired spacing interval is achieved and/or maintained within the IM tolerance in the assumed operating environment, and the closeness between the upper and lower bounds promotes interoperability between different speed control algorithm implementations.

Figure 2:
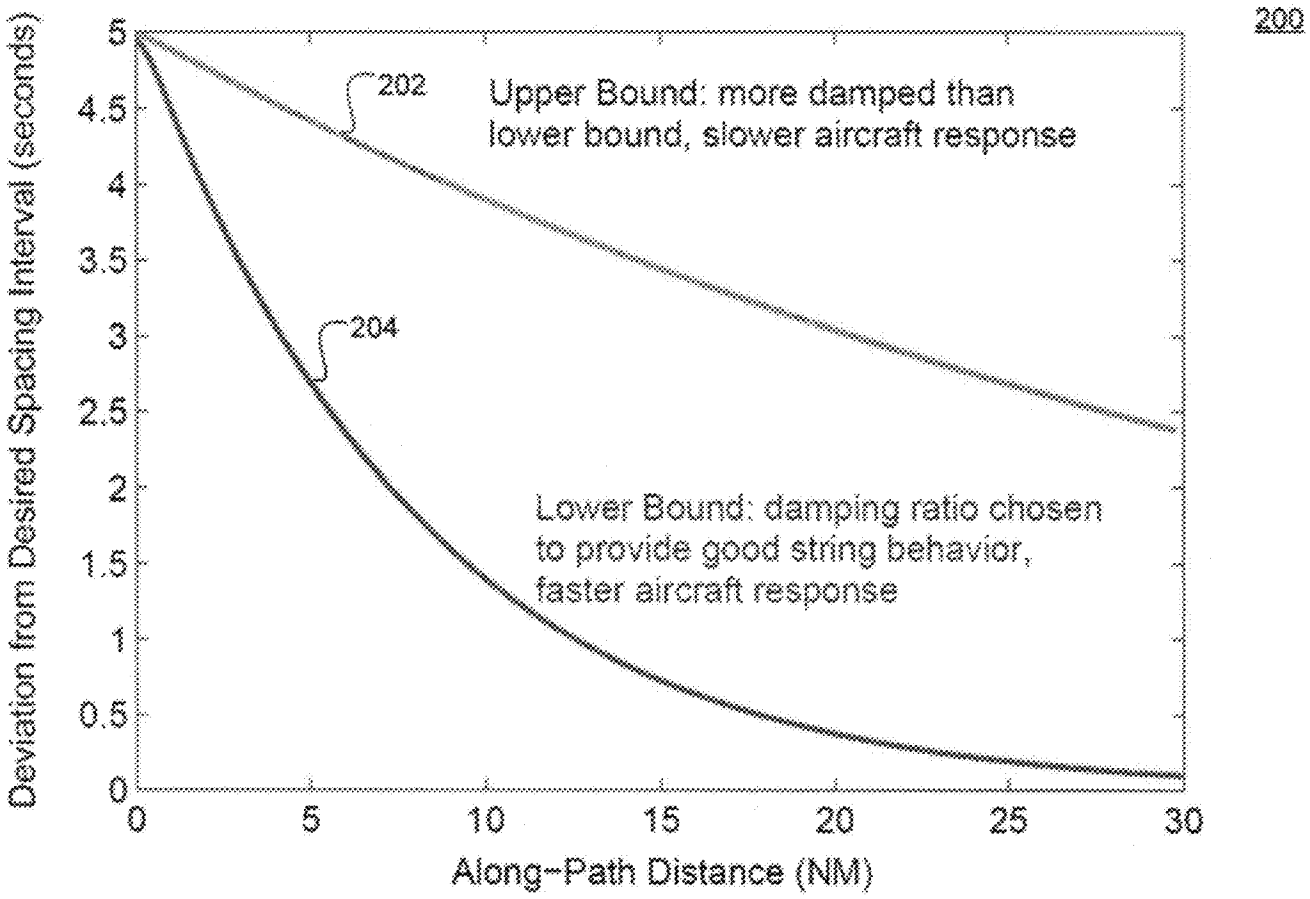
FIG. 2 shows a plot illustrating exemplary upper and lower bounds on an exemplary correction of a deviation from an exemplary desired spacing interval.

FIG. 2 shows a plot 200 illustrating the upper and lower bounds on the correction of the deviation from the desired spacing interval. The evolution of the deviation is shown when correcting a 5-second initial spacing-interval deviation relative to a target aircraft flying at a constant speed. In FIG. 2, a curve 202 represents the evolution of the upper bound on the correction of a deviation in the spacing interval from the desired spacing interval and a curve 204 represents the evolution of the lower bound on the correction of a deviation in the spacing interval from the desired spacing interval. Each bound is characterized by a damping ratio and an aircraft response to a new speed. The lower bound is less damped than the upper bound and assumes a faster aircraft response.

Characterizing the assumed operating environment by the operational uncertainties that are expected in the IM operation is one approach towards establishing the different speed performance levels. For a fixed speed performance level (e.g., fixed upper and lower bounds on damping ratio and aircraft response), the response curves can be generated for each operational uncertainty expected in an IM operation and used to predict the ability to achieve the IM tolerance at that performance level.

The assumed operating environment can be related to the speed performance level in the establishment of the RIMP category in a variety of ways. For example, validation of the speed performance levels in assumed operating environments, for example, by fast-time simulation, can be used in establishing the relationships between the performance levels and the operating environments.

The variation found in the environment and IM tolerance requirements of the IM operations studied to date is noteworthy. This variation indicates that requiring all FIM equipment to perform at the most stringent speed performance levels only would lead to inefficient performance as the IM aircraft would in some cases be unnecessarily working towards a tighter IM tolerance than that specified by the ORTs. The most flexible FIM equipment could be certified for all defined speed performance levels, which would provide the most efficient performance in all IM operations.

As in the case of determining the state data performance levels, a closed-form analysis of the spacing uncertainty that results from the combination of operating environment and speed control algorithm with a given performance level can be a useful ingredient in the RIMP methodology. This would provide an analysis that is independent of a specific speed control algorithm implementation. Furthermore, an analytical process for relating the speed performance level to the assumed operating environment provides a flexible framework for determining the performance level needed for a new IM operation without extensive validation.

Depending upon how the assumed operating environment is defined in conjunction with the performance levels, a set of bench tests can be used to certify FIM equipment to a given speed performance level. These bench tests can be exhaustive, ranging from verification of simple input responses to required performance in simulated environments.

IV. Characterizing Airborne Spacing Operations with RIMP

Figure 3:
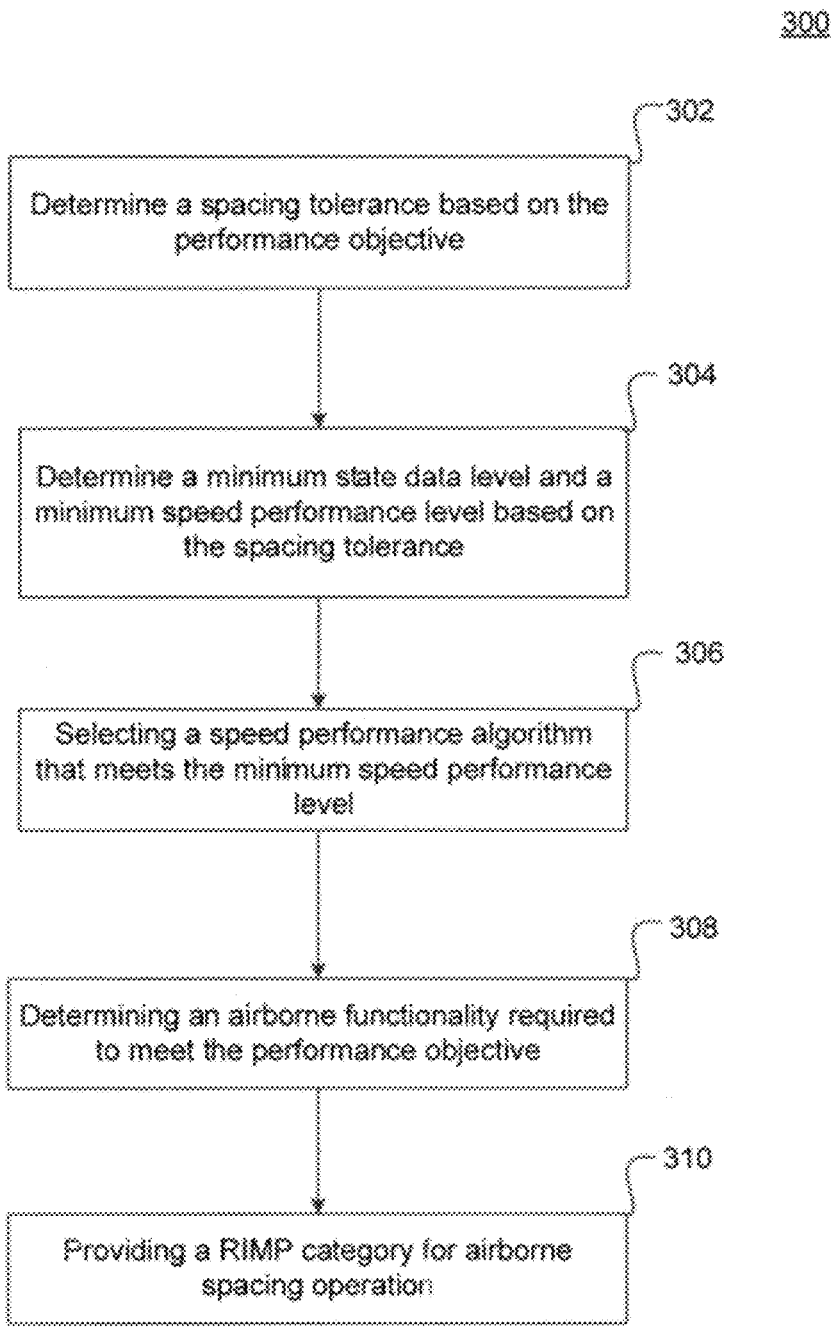
FIG. 3 shows a flowchart providing example steps for characterizing an IM operation, according to an embodiment of the present invention.

As described above, the RIMP category for an airborne spacing operation can specify the spacing tolerance, the minimum performance levels of the state data and the speed control algorithm that guarantee the IM tolerance in the assumed operating environment, and the level of functionality required by the FIM equipment. FIG. 3 shows a flowchart 300 providing example steps for characterizing an airborne spacing operation with a RIMP category, according to an embodiment of the present invention. The steps shown in FIG. 3 do not necessarily have to occur in the order shown.

Figure 4:
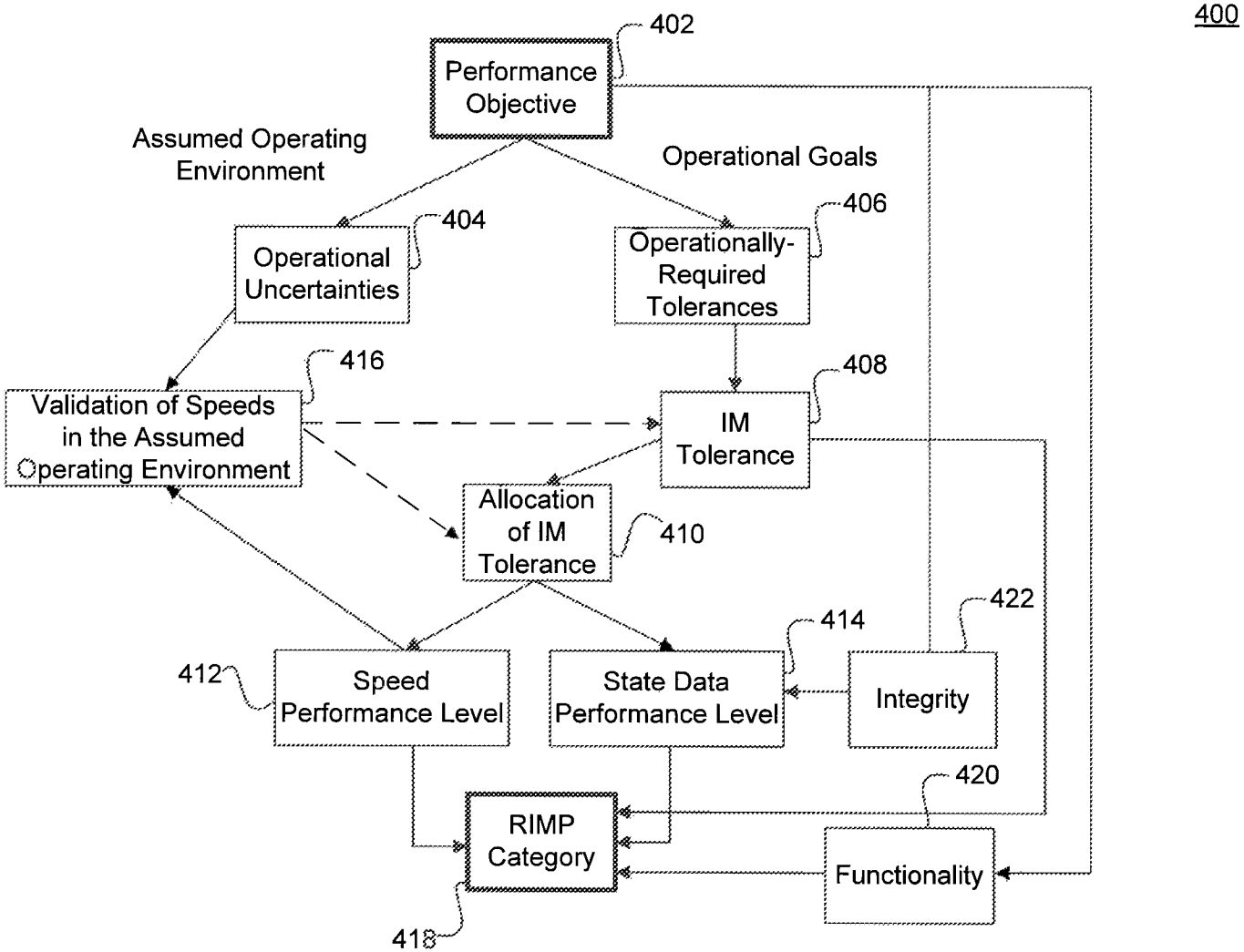
FIG. 4 shows a data flow diagram associated with the flowchart of FIG. 3, according to embodiment of the present invention.
Figure 5:
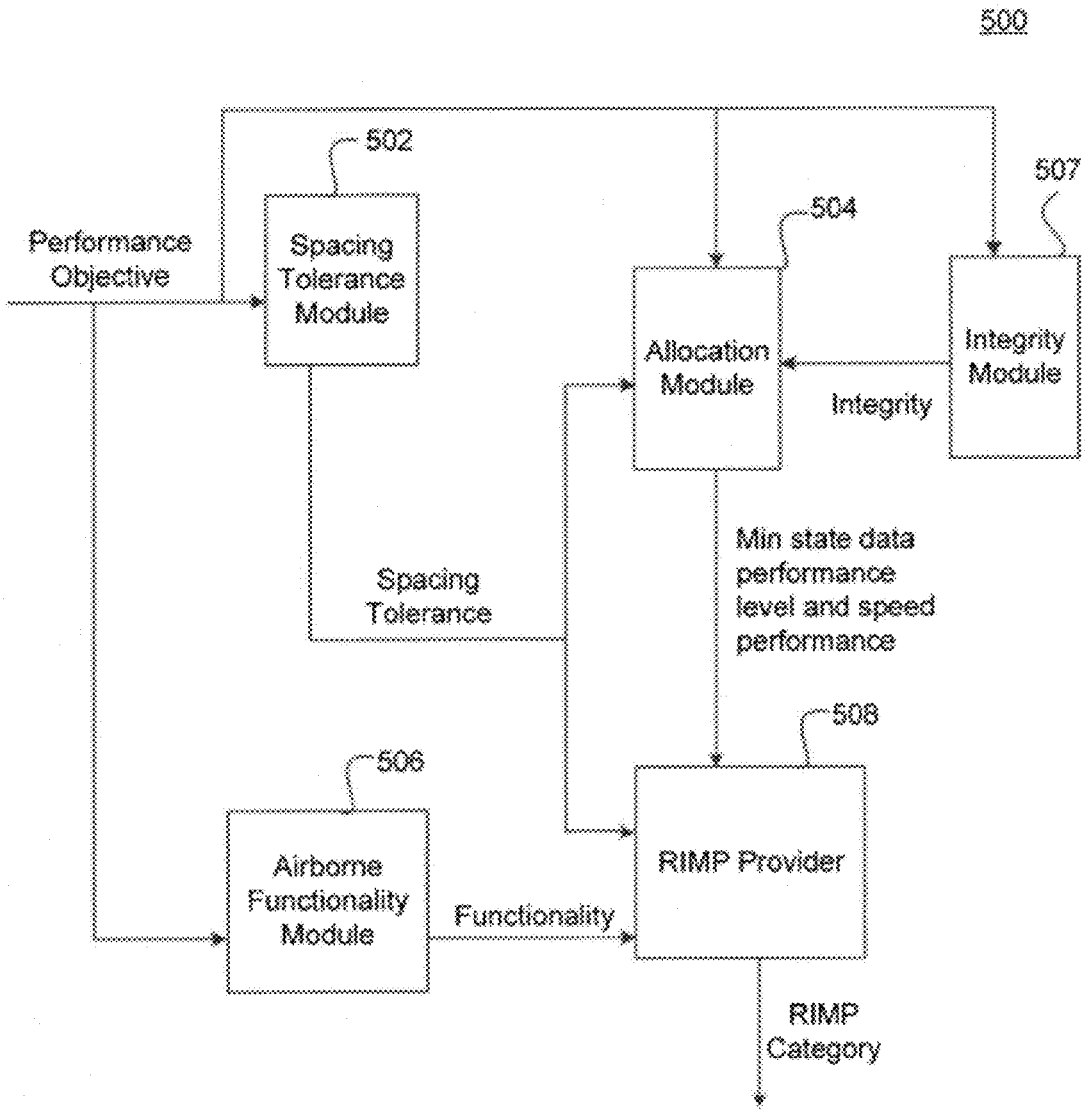
FIG. 5 shows a computer system that can be used to characterize an IM operation, according to an embodiment of the present invention.
Figure 7:
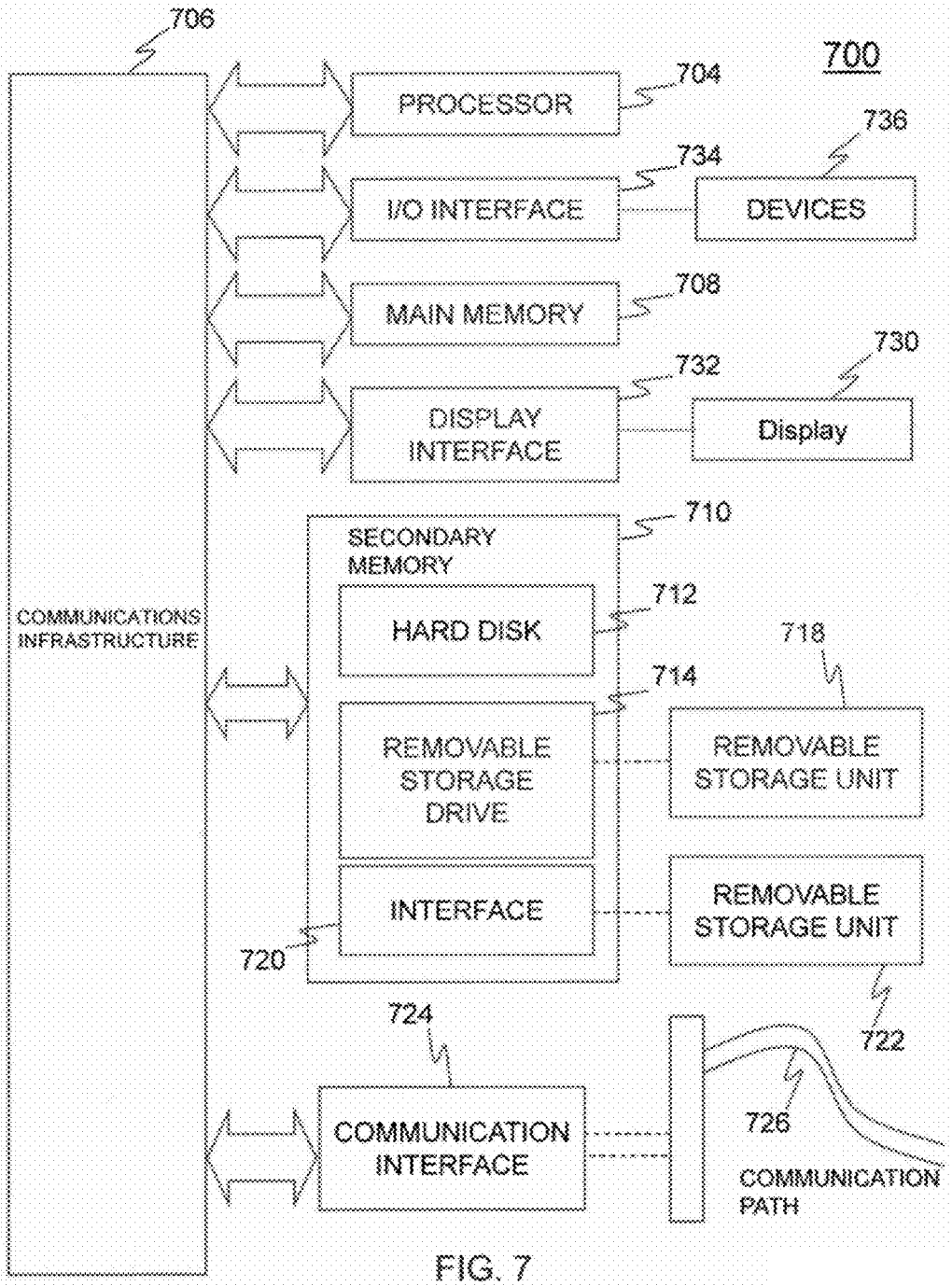
FIG. 7 is a block diagram schematically illustrating an example computer system in which embodiments can be implemented.

FIG. 4 shows an exemplary data flow diagram, according to an embodiment of the present invention, that will be described with the steps of flowchart 300. Moreover, FIG. 5 shows an exemplary computing system 500 that can be used to execute some or all of the steps of flowchart 300, according to an embodiment of the present invention. FIG. 7 shows an exemplary computing environment that can be used to implement some or all of computing system 500. The elements of computer system 700 will be described in section VI entitled "Exemplary Computing Environment." As would be appreciated by those skilled in the relevant arts based on the description herein, the steps of flowchart 300 are not limited to the embodiments of FIGS. 4, 5, and 7.

Furthermore, flowchart 300 is described with respect to example embodiment in which the steps of flowchart 300 are used to characterize an operation seeking to achieve a desired inter-aircraft spacing at a waypoint in the terminal area. Given a sequence and scheduled times of arrival at the waypoint, the controller determines the desired spacing intervals needed between each aircraft at the waypoint. Specifically, the operational goal for this example is to limit drift in the schedule to ±2 minutes, 95%, per hour of operation, and the controller intervention threshold is modeled to be one-third of the desired spacing interval.

In step 302, a spacing tolerance is determined based on the performance objective. In FIG. 4, the performance objective of the IM operation (block 402) is used to determine ORTs (block 406) including the nominal spacing bounds and the controller intervention threshold. The ORTs are then used to determine the IM tolerance (block 408). For example, in FIG. 5, a spacing tolerance module 502 can be used to determine a spacing tolerance based on the performance objective.

In the example described above, the spacing tolerance can be determined as follows. Assuming that N aircraft are scheduled to arrive over the next hour, the time for N aircraft to cross the terminal-area waypoint in an hour is described by the random variable Y in eq. (1) (shown below), where $\Delta_i$ is the desired spacing interval of the ith aircraft relative to its target aircraft, and $X_i$ is a Gaussian-distributed random variable with standard deviation σ representing the deviation in the actual spacing interval from the desired spacing interval at the waypoint. The $X_i$s are assumed to be independent, identically-distributed random variables.

$$Y = (\Delta_1 + X_1) + (\Delta_2 + X_2) + \ldots + (\Delta_N + X_N) \tag{1}$$

$$= \sum_{i=1}^{N} \Delta_i + \sum_{i=1}^{N} X_i$$

$$= 3600 \text{ seconds} + \sum_{i=1}^{N} X_i.$$

Thus, the random variable Y is also Gaussian distributed with a mean of 3600 seconds and a standard deviation of $\sqrt{N}\sigma$.

The standard deviation corresponding to the nominal spacing bounds on the individual aircraft spacing precision that satisfies the operational goal of limiting the variation of Y to 120 seconds, 95%, can be determined using eq. (2) shown below.

$$\sigma \leq \frac{120 \text{ seconds}}{1.96\sqrt{N}} \tag{2}$$

To reconcile the 99.9% bound on performance defined by the nominal spacing bound with the controller intervention threshold, eq. (3) (shown below) is verified for each desired spacing interval $\Delta_i$.

$$3.29\sigma \leq \frac{\Delta_i}{3} \tag{3}$$

Assuming that the desired spacing interval between aircraft is 120 seconds, resulting in an average of 30 aircraft crossing the waypoint per hour, the resulting value of σ from eq. 2 is 11.2 seconds, which respects the controller intervention threshold, as per the inequality in eq. 3.

However, in the case of 40 aircraft scheduled to cross the waypoint in an hour and a desired spacing interval of 90 seconds along the string, the controller intervention threshold drives the performance needed. The standard deviation that satisfies the operational goal is 9.7 seconds from eq. 2, but a value of σ equal to 9.1 seconds is required to satisfy eq. 3. The resulting IM tolerance of 17.9 seconds is used for the rest of this example.

In step 304, a minimum state data performance level and a minimum speed performance level are determined based on the spacing tolerance. In one embodiment, step 304 can include allocating the spacing tolerance to the minimum state data performance level, which can include the integrity, and the minimum speed performance level. In FIG. 4, in block 410, the IM tolerance is allocated to the speed performance level (block 412) and the state data performance level (block 414). Moreover, the integrity can be also be specified based on the performance objective (block 422). As shown in FIG. 4, the allocation to the speed performance level can be based on the validation of speeds in the assumed operating environment (block 416), which is in turn dependent on the operational uncertainties associated with the assumed operating environment (block 404). For example, in FIG. 5, allocation module 504 and integrity module 507 can determine the minimum state data performance level based on the spacing tolerance and the performance objective, respectively. Specifically, integrity module 507 can determine the integrity based on the performance objective and provide the objective to allocation module 504. The minimum state data performance level provided by allocation module 504 includes the integrity provided by integrity module 507. Moreover, the allocation module 504 can also determine the minimum speed performance level based on the spacing tolerance.

In the example described above, the minimum state data performance level and the minimum speed performance level can be determined as follows. An initial allocation is made to the speed performance in the assumed operating environment. Because the relationship between the IM operation and the assumed operating environment has not yet been established, the initial allocation to the speed performance is determined based on previous IM-related studies. Speed control algorithms for IM-related concepts have been tested in fast-time simulation environments, human-in-the-loop experiments, and field testing with different environments of varying complexity. It has been found that the spacing precision ranged from 6.0 to 10.0 seconds, 95%, using fast-time simulations.

An initial conservative allocation of 13.0 seconds can be made to the speed performance in the assumed operating environment, from which the state data error budget is then determined. The state data error budget is given by eq. (4) below.

$$\text{State data error budget} = \sqrt{(IM\ \text{Tolerance})^2 - (\text{Speed Performance})^2} = \sqrt{(17.9)^2 - (13.0)} = 12.3\ \text{sec} \quad (4)$$

The state data error budget is met for Performance Level 1, as defined in reference RTCA, where state data for the IM and target aircraft have a horizontal position accuracy of 0.3 NM and a horizontal velocity accuracy of 10 m/s; update rates and latencies in the target aircraft state data are assumed for the expected surveillance source (e.g., ADS-B, ADS-R, or TIS-B). Performance Level 1, as defined in reference RTCA, is provided herein by way of example only and is not intended to limit the scope of the invention. For a target aircraft equipped with ADS-R, the bound on the spacing interval uncertainty is 7.1 seconds. This value is found using the conservative model of the spacing interval uncertainty resulting from state-data errors described in RTCA. The remainder of the state data error budget is re-allocated to the speed performance resulting in a 16.4-second budget for the speeds in the environment.

The speed performance in the assumed operating environment must be validated to show that the 16.4-second budget is met. Initially, fast-time simulations of a baseline implementation will be performed to demonstrate viability of the IM operation.

In step 306, a speed control algorithm is selected that meets the minimum speed performance level. For example, in FIG. 5, allocation module 504 can be configured to select an appropriate speed performance algorithm based on the speed performance level. For example, in the example described above, one of a variety of different speed performance algorithms that can meet the 16.4-second budget in the specified operating conditions can be selected.

In step 308, an airborne functionality required to meet the performance objective can be determined. For example, in FIG. 5, airborne functionality module 506 can be used to determine a level of airborne functionality needed to meet the performance objective. In a further embodiment, the airborne functionality can be determined such that the minimum state date performance level is also met. In the example described above, it can be determined that no additional functionality above the baseline functionality would be needed to meet the performance objective.

In step 310, a RIMP category is provided for the spacing operation. As shown in FIG. 4, RIMP category (block 418) incorporates the minimum speed performance level (block 412) and the minimum state data performance level (block 414) as well as the IM tolerance (block 408) and the additional functionality of the FIM equipment (block 420) determined from the performance objective of the IM operation (block 402). In alternate embodiments, the RIMP category can include one or more of the minimum speed performance level (block 412), the minimum state data performance level (block 414), the IM tolerance (block 408), and the additional functionality of the FIM equipment (block 420). For example, in such an embodiment, the RIMP category can include only the minimum speed performance level, the minimum state data performance level, and the IM tolerance.

In the example described above, RIMP category would be comprised of an IM tolerance of 18 seconds, state data performance level 1, the appropriate speed performance level, and no additional airborne functionality above the baseline functionality. In an embodiment, the RIMP category can be provided as an operationally-appropriate term. For example, the RIMP category described in this exemplary embodiment can be denoted as "RIMP 10" or other similar language. In doing so, a single term is used to describe the IM requirements for this operation.

V. Exemplary Characterization

To further illustrate the operation of the steps of flowchart 300, a second exemplary embodiment of characterizing an airborne spacing operation is provided below. As with the first example described above, the second example is not intended to limit the scope and spirit of the present invention.

The second example is an IM operation for arrival spacing to achieve a desired throughput of 30 aircraft per hour at the runway threshold. This is a more complex IM operation to analyze than the example IM operation described above, and this example shows the applicability of the ORT metrics and RIMP analysis to IM operations with different operational objectives.

IM Tolerance: The IM tolerance for an arrival operation is determined in order to achieve the desired throughput at the runway threshold. The IM operation is terminated at the final approach fix (FAF) when the aircraft begins its deceleration to its final approach speed. Therefore, the IM tolerance is determined at the FAF such that the operational goal is achieved at the runway threshold.

Throughput at the runway threshold is a function of the mean inter-aircraft spacing or the average desired spacing interval, which is set during a sequence of consecutive IM operations. In this operation, the desired spacing intervals are set such that wake vortex minimum separation is respected in 99.9% of operations, under fault-free conditions. The nominal spacing bounds for each individual IM operation in the sequence can be modeled by a Gaussian distribution with mean equal to the desired spacing interval and standard deviation equal to $\sigma_{threshold}$.

The controller intervention threshold is modeled to be at the wake vortex minimum separation. The modeling of the nominal spacing bounds already ensures that this threshold is appropriately respected under the assumption that nominal spacing performance is Gaussian. Additional measures such as alerting may be required for robustness, for example, if the IM operation involves particularly volatile wind conditions.

The arrival operation is comprised of a mix of aircraft categories, and the minimum (time-based) spacing intervals between aircraft pairs are shown in Table I. The spacing intervals can be derived based upon wake-vortex separation standards and representative final approach speeds for the different aircraft categories.

TABLE 1

Time-Based Wake Vortex Minimum Separation (Seconds)

| | | Target Aircraft | | |
|---|---|---|---|---|
| | | Heavy | B757 | Large |
| IM Aircraft | Heavy | 110 | 110 | 84 |
| | B757 | 126 | 78 | 78 |
| | Large | 136 | 113 | 86 |

The desired spacing interval is set so that one side of the two-sided 99.9% bound, or 3.29 times $\sigma_{threshold}$, is the wake vortex minimum separation. The matrix w represents of the spacing intervals in Table I, where the column index represents the target aircraft category in the pair, and the row index represents the IM aircraft category in the pair.

Spacing $\text{Interval}_{threshold}$=w+3.29σ, where $$w = \begin{bmatrix} 110 & 110 & 84 \\ 126 & 78 & 78 \\ 136 & 113 & 86 \end{bmatrix}$$

For an assumed aircraft-type mix, the average spacing interval at the runway $\bar{t}_{threshold}$ can be determined.

$$\bar{t}_{threshold} = \sum_{i=1}^{3}\sum_{j=1}^{3} \text{Spacing } Interval_{threshold}(i, j)(p_i)(p_j)$$

Here, p(i) for i=1, 2, 3, is the probability of a heavy, a B757, or a large aircraft, respectively, in the sequence. The throughput at the runway threshold is determined from the average spacing interval.

$$throughput_{threshold}(\text{aircraft/hour}) = \frac{3600}{\bar{t}_{threshold}}$$

Figure 6:
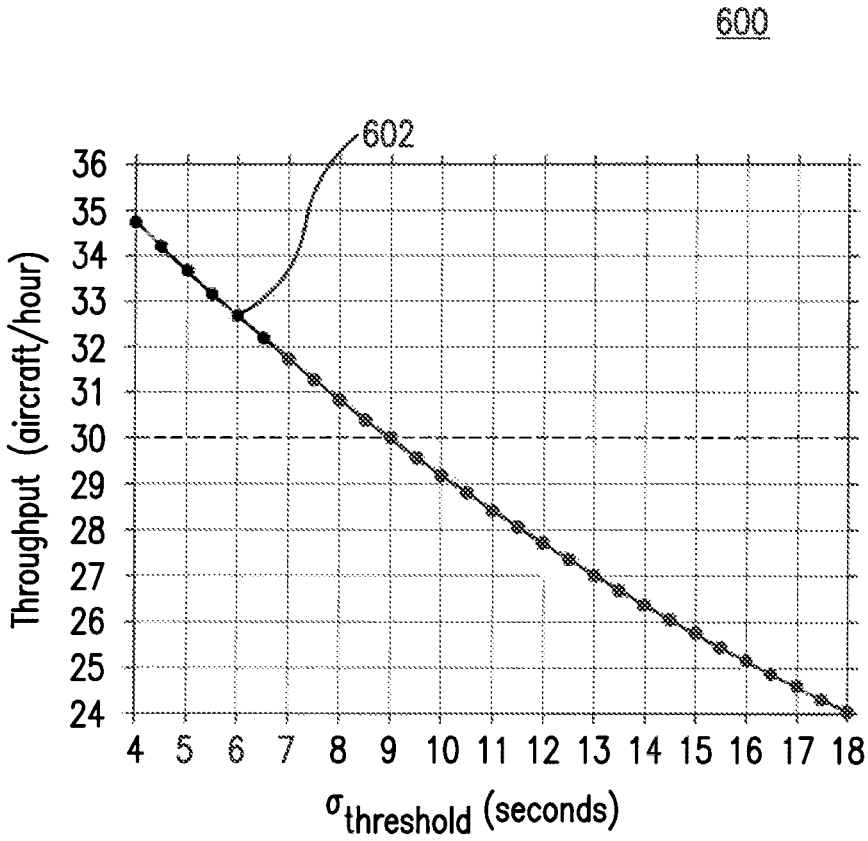
FIG. 6 shows a plot having a curve that illustrates the throughput at the runway.

To determine the throughput at the runway threshold, the following aircraft-type mix is assumed: p(1)=0.10, p(2)=0.70, p(3)=0.20; e.g., there is a 70% probability that a B757 is next in the sequence. FIG. 6 shows a plot 600 having a curve 602 that illustrates the throughput at the runway threshold for different values of the standard deviation $\sigma_{threshold}$. The intersection of the curve and the 30 aircraft per hour throughput shows that a standard deviation of 9.0 seconds meets the operational goal.

Because the IM operation is terminated at the FAF, the controller provides the IM aircraft with the desired spacing interval to be achieved at the FAF such that the spacing interval needed at the threshold is achieved. The desired spacing interval at the FAF is a function of the times that it takes for the IM and target aircraft to fly from the FAF to the threshold, where the times are computed assuming planned final approach speeds, decelerations to the final approach speeds, and wind speeds between the FAF and the threshold. Therefore, the IM tolerance needed at the FAF is a function of the 95% bound on the spacing at the runway threshold and the 95% bound on the uncertainties in the times for the IM and target aircraft to fly from the FAF to the threshold. This can be modeled by a Gaussian distribution with standard deviation $\sigma_T$.

$$\text{IM Tolerance}==\sqrt{(1.96\sigma_{threshold})^2-(1.96\sigma_T)^2}$$

These uncertainties are a result of errors in the planned final approach speeds, decelerations to the final approach speeds, and winds used to determine the desired spacing interval at the FAF. To determine $\sigma_T$, the flight times for the IM and target aircraft from the FAF to the threshold, $T_{IM}$ and $T_{target}$, respectively, are modeled as independent, identically distributed random variables. Monte-Carlo analysis is used to determine the standard deviations of $T_{IM}$ and $T_{target}$, where the final approach speeds are assumed known within 5 knots, 95%, the decelerations are assumed known within 0.15 knots/second, 95%, and the wind is assumed known within 10 knots, 95%. The standard deviations of TIM and Ttarget are 5.2 seconds from which σT is determined in RTCA.

$$\sigma_T=\sqrt{(1.96\sigma_{T_{IM}})^2-(1.96\sigma_{T_{target}})^2}=7.4 \text{ sec}$$

Therefore, an IM tolerance of 10.2 seconds is needed at the FAF.

2) IM Tolerance Allocations: As described in the first example, an initial allocation is made to the speed performance in the assumed operating environment. References B. Barmore, "Airborne Precision Spacing: A Trajectory-Based Approach to Improve Terminal Area Operations," in Proceedings of the 25$^{th}$ Digital Avionics and Systems Conference, Portland, Oreg., 2006, which is incorporated herein in its entirety, and J. L. Murdoch et al. "Evaluation of an Airborne Spacing Concept to Support Continuous Descent Arrival Operations," in Proceedings of the Eights US/Europe Air Traffic Research and Development Seminar, June 2009, which is incorporated herein in its entirety, found that the spacing precision at the runway threshold ranged from 7.5 to 10.0 seconds, 95%, determined from fast time simulations and human-in-the-loop experiments. Thus, an initial allocation of 8.0 seconds is made to the speed performance in the assumed operating environment, from which the state data error budget is determined to be 6.3 seconds.

The state data error budget is met for Performance Level 2, as defined in RTCA, where state data for the IM and target aircraft have a horizontal position accuracy of 0.1 NM and a horizontal velocity accuracy of 3 m/s; update rates and latencies in the target aircraft state data are assumed for the expected surveillance source. For a target aircraft equipped with ADS-B, the bound on the spacing interval uncertainty is 5.8 seconds as noted in RTCA. The remainder of the state data error budget is re-allocated to the speed performance budget resulting in an 8.4-second budget for the speeds in the environment.

Again, the speed performance in the assumed operating environment must be validated to show that the allocated 8.4-second budget is respected.

3) RIMP Category: The RIMP category for this IM operation can be an operationally-appropriate term that specifies an IM tolerance of 10 seconds, state data performance level 2, the appropriate speed control performance level, and no additional airborne functionality above the baseline functionality.

If the IM operation had higher throughput goals at the runway threshold, the FIM equipment may require knowledge of the IM and target aircraft final approach speeds in order to better predict trajectories from the FAF to the runway threshold. In this case, the added functionality to know and use final approach speeds would be included in the RIMP category along with the appropriate IM tolerance and performance levels to support the tighter IM tolerance.

As described above, RIMP categories can specify the following:

- the spacing precision needed in the IM operation to meet operational goals,
- the required performance of the state data provided by the IM and target aircraft and used by the FIM equipment to calculate speeds,
- the required performance of the speed control algorithm in the assumed operating environment, and
- additional functional capabilities of the FIM equipment.

The RIMP categories describe the performance needed for an IM operation, and this categorization framework may be leveraged by, for example, air traffic controllers managing IM operations with changing operational goals and operating environments and by FIM equipment designers to provide efficient performance as a function of RIMP category. In a further embodiment, discrete performance levels of the state data and the speed performance can be used to facilitate equipment-level testing and certification procedures.

VI. Exemplary Computing Environment

Embodiments shown in FIGS. 3, 4, and 5, or any part(s) or function(s) thereof, may be implemented using hardware, software modules, firmware, tangible computer readable media having instructions stored thereon, or a combination thereof and may be implemented in one or more computer systems or other processing systems.

FIG. 7 illustrates an example computer system 700 in which embodiments, or portions thereof, may be implemented as computer-readable code. For example, computing system 500 or portions thereof can be implemented in computer system 700 using hardware, software, firmware, tangible computer readable media having instructions stored thereon, or a combination thereof and may be implemented in one or more computer systems or other processing systems. Hardware, software, or any combination of such may embody any of the modules and components in FIG. 5.

If programmable logic is used, such logic may execute on a commercially available processing platform or a special purpose device. One of ordinary skill in the art may appreciate that embodiments of the disclosed subject matter can be practiced with various computer system configurations, including multi-core multiprocessor systems, minicomputers, mainframe computers, computer linked or clustered with distributed functions, as well as pervasive or miniature computers that may be embedded into virtually any device.

For instance, at least one processor device and a memory may be used to implement the above described embodiments. A processor device may be a single processor, a plurality of processors, or combinations thereof. Processor devices may have one or more processor "cores."

Various embodiments are described in terms of this example computer system 700. After reading this description, it will become apparent to a person skilled in the relevant art how to implement embodiments using other computer systems and/or computer architectures. Although operations may be described as a sequential process, some of the operations may in fact be performed in parallel, concurrently, and/or in a distributed environment, and with program code stored locally or remotely for access by single or multi-processor machines. In addition, in some embodiments the order of operations may be rearranged without departing from the spirit of the disclosed subject matter.

Processor device 704 may be a special purpose or a general purpose processor device. As will be appreciated by persons skilled in the relevant art, processor device 704 may also be a single processor in a multi-core/multiprocessor system, such system operating alone, or in a cluster of computing devices operating in a cluster or server farm. Processor device 704 is connected to a communication infrastructure 704, for example, a bus, message queue, network, or multi-core message-passing scheme.

Computer system 700 also includes a main memory 708, for example, random access memory (RAM), and may also include a secondary memory 710. Secondary memory 710 may include, for example, a hard disk drive 712, removable storage drive 714. Removable storage drive 714 may comprise a floppy disk drive, a magnetic tape drive, an optical disk drive, a flash memory, or the like. The removable storage drive 714 reads from and/or writes to a removable storage unit 718 in a well known manner. Removable storage unit 718 may comprise a floppy disk, magnetic tape, optical disk, etc. which is read by and written to by removable storage drive 714. As will be appreciated by persons skilled in the relevant art, removable storage unit 718 includes a computer usable storage medium having stored therein computer software and/or data.

In alternative implementations, secondary memory 710 may include other similar means for allowing computer programs or other instructions to be loaded into computer system 700. Such means may include, for example, a removable storage unit 722 and an interface 720. Examples of such means may include a program cartridge and cartridge interface (such as that found in video game devices), a removable memory chip (such as an EPROM, or PROM) and associated socket, and other removable storage units 722 and interfaces 720 which allow software and data to be transferred from the removable storage unit 722 to computer system 700.

Computer system 700 can include a display interface 732 for interfacing a display unit 730 to computer system 700. Display unit 730 can be any device capable of displaying user interfaces according to this invention, and compatible with display interface 732. Examples of suitable displays include liquid crystal display panel based device, cathode ray tube (CRT) monitors, organic light-emitting diode (OLED) based displays, and touch panel displays. For example, computing system 500 can include a display 730 for displaying graphical user interface elements.

Computer system 700 may also include a communications interface 724. Communications interface 724 allows software and data to be transferred between computer system 700 and external devices. Communications interface 724 may include a modem, a network interface (such as an Ethernet card), a communications port, a PCMCIA slot and card, or the like. Software and data transferred via communications interface 724 may be in the form of signals, which may be electronic, electromagnetic, optical, or other signals capable of being received by communications interface 724. These signals may be provided to communications interface 724 via a communications path 726. Communications path 726 carries signals and may be implemented using wire or cable, fiber optics, a phone line, a cellular phone link, a radio-frequency (RF) link or other communications channels.

Auxiliary I/O device interface 734 represents general and customized interfaces that allow processor device 704 to send and/or receive data from other devices 736, such as microphones, touch-sensitive displays, transducer card readers, tape readers, voice or handwriting recognizers, biometrics readers, cameras, portable mass storage devices, and other computers. Device interface 734 may perform signal conditioning and processing functions such as analog to digital and digital to analog conversion, amplification and filtering of device generated signals, and generation of hand-shaking signals to coordination the operation of devices 736 with the operations of computer system 700. For example, computing system 500 can include a touch screen device for capturing user manipulation of graphical user interface elements.

In this document, the terms "computer program medium" and "computer readable medium" are used to generally refer to storage media such as removable storage unit 718, removable storage unit 722, and a hard disk installed in hard disk drive 712. Computer program medium and computer usable medium may also refer to memories, such as main memory 708 and secondary memory 710, which may be memory semiconductors (e.g. DRAMs, etc.).

Computer programs (also called computer control logic) are stored in main memory 708 and/or secondary memory 710. Computer programs may also be received via communications interface 724. Such computer programs, when executed, enable computer system 700 to implement embodiments as discussed herein. In particular, the computer programs, when executed, enable processor device 704 to implement the processes of embodiments, such as the stages of the methods illustrated by flowchart 300 Accordingly, such computer programs can be used to implement controllers of the computer system 700. Where embodiments are implemented using software, the software may be stored in a computer program product and loaded into computer system 700 using removable storage drive 714, interface 720, and hard disk drive 712, or communications interface 724.

Embodiments also may be directed to computer program products comprising software stored on any computer readable medium. Such software, when executed in one or more data processing devices, causes a data processing device(s) to operate as described herein. For example, the software can cause data processing devices to carry out the steps of flowchart 300 FIG. 3.

Embodiments employ any computer useable or readable medium. Examples of tangible, computer readable media include, but are not limited to, primary storage devices (e.g., any type of random access memory), secondary storage devices (e.g., hard drives, floppy disks, CD ROMS, ZIP disks, tapes, magnetic storage devices, and optical storage devices, MEMS, nano-technological storage device, etc.). Other computer readable media include communication mediums (e.g., wired and wireless communications networks, local area networks, wide area networks, intranets, etc.).

VII. Conclusion

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

The claims in the instant application are different than those of the parent application or other related applications. The Applicant therefore rescinds any disclaimer of claim scope made in the parent application or any predecessor application in relation to the instant application. The Examiner is therefore advised that any such previous disclaimer and the cited references that it was made to avoid, may need to be revisited. Further, the Examiner is also reminded that any disclaimer made in the instant application should not be read into or against the parent application.

What is claimed is:

1. A method of characterizing an airborne spacing operation, comprising:

determining, using a computer, a spacing tolerance based on a performance objective for the spacing operation;

determining, using a computer, a minimum state data performance level and a minimum speed performance level based on the spacing tolerance;

determining, using a computer, an airborne functionality required to meet the performance objective; and providing, using a computer, a required interval management performance (RIMP) category for the airborne spacing operation, the RIMP category specifying the spacing tolerance, the minimum state data performance level, the minimum speed performance level, and the airborne functionality.

2. The method of claim 1, wherein determining the minimum state data performance level and the minimum speed performance level comprises:

determining a required integrity of the spacing operation, wherein the integrity of the spacing is included in the minimum state data performance level.

3. The method of claim 1, wherein determining the spacing tolerance comprises:

determining the spacing tolerance as a tolerance that satisfies both a nominal spacing bound corresponding to the performance objective and a controller intervention threshold corresponding to the performance objective.

4. The method of claim 3, wherein determining the spacing tolerance further comprises:

determining the nominal spacing bound corresponding to the performance objective; and determining the controller intervention threshold corresponding to the performance objective.

5. The method of claim 1, wherein determining a minimum state data performance level and a minimum speed performance level comprises:

calculating an initial allocation of the spacing tolerance to a speed performance based on an expected operating environment for the spacing operation.

6. The method of claim 5, wherein determining a minimum state data performance level and a minimum speed performance level further comprises:

calculating an allocation of the spacing tolerance to a state data error based on the initial allocation of the spacing tolerance to the speed performance.

7. The method of claim 6, wherein determining a minimum state data performance level and a minimum speed performance level further comprises:

selecting as the minimum state data performance level as a state data performance level that meets the allocation of the spacing tolerance to the state data error.

8. The method of claim 7, wherein determining a minimum state data performance level and a minimum speed performance level further comprises:

determining the minimum speed performance level based on the minimum state data performance level.

9. The method of claim 8, further comprising:

selecting a speed performance algorithm that meets the minimum speed performance level.

10. The method of claim 1, wherein the RIMP category is denoted by an operationally-appropriate term.

11. The method of claim 1, wherein the airborne functionality is specified relative to a baseline airborne functionality.

12. The method of claim 1, wherein determining the airborne functionality comprises:

identifying the airborne functionality as an airborne functionality that can meet the performance objective.

13. A system for characterizing an airborne spacing operation, comprising:

a spacing tolerance module configured to determine a spacing tolerance based on a performance objective for the spacing operation;

an allocation module configured to determine a minimum state data performance level and a minimum speed performance level based on the spacing tolerance;

an airborne functionality module configured to determine an airborne functionality required to meet the performance objective; and a required interval management performance (RIMP) provider configured to provide a RIMP category for the spacing operation, the RIMP category specifying the spacing tolerance, the minimum state data performance level, the minimum speed performance level, and the airborne functionality.

14. The system of claim 13, wherein the allocation module is configured to calculate an initial allocation of the spacing tolerance to a speed performance based on an expected operating environment for the spacing operation.

15. The system of claim 14, wherein the allocation module is configured to calculate an allocation of the spacing tolerance to a state data error based on the initial allocation of the spacing tolerance to the speed performance.

16. The system of claim 15, wherein the allocation module is configured to determine the minimum state data performance level based on the allocation of the spacing the state data error.

17. The system of claim 16, wherein the allocation module is configured to determine the minimum speed performance level based on the minimum state data performance level.

18. The system of claim 13, further comprising:

an integrity module configured to determine an integrity based on the performance objective, wherein the minimum state data performance level comprises the integrity.

19. A tangible computer program product comprising a computer usable medium having control logic embodied in the medium that, when executed by a computer, causes the computer to perform operations to characterize an airborne spacing operation, the operations comprising:

determining a spacing tolerance based on a performance objective for the spacing operation;

determining a minimum state data performance level and a minimum speed performance level based on the spacing tolerance;

determining a minimum state data performance level based on the performance objective;

determining an airborne functionality required to meet the performance objective; and providing a required interval management performance (RIMP) category for the airborne spacing operation, the RIMP category specifying the spacing tolerance, the minimum state data performance level, the minimum speed performance level, and the airborne functionality.

20. The computer program product of claim 19, the operations further comprising:

determining a required integrity of the spacing operation, wherein the integrity of the spacing is included in the minimum state data performance level.

21. The computer program product of claim 19, wherein determining the spacing tolerance comprises:

determining the spacing tolerance as a tolerance that satisfies both a nominal spacing bound corresponding to the performance objective and a controller intervention threshold corresponding to the performance objective.

22. The computer program product of claim 19, wherein determining a minimum state data performance level and a minimum speed performance level comprises:

calculating an initial allocation of the spacing tolerance to a speed performance based on an expected operating environment for the spacing operation.

23. The computer program product of claim 22, wherein determining a minimum state data performance level and a minimum speed performance level further comprises:

calculating an allocation of the spacing tolerance to a state data error based on the initial allocation of the spacing tolerance to the speed performance.

24. The computer program product of claim 23, wherein determining a minimum state data performance level and a minimum speed performance level further comprises:

determining the minimum state data performance level based on the allocation of the spacing tolerance to the state data error.

25. The computer program product of claim 24, wherein determining a minimum state data performance level and a minimum speed performance level further comprises:

determining the minimum speed performance level based on the minimum state data performance level.

26. The computer program product of claim 19, the operations further comprising:

selecting a speed performance algorithm based on the minimum speed performance level.

* * * * *

UNITED STATES PATENT AND TRADEMARK OFFICE

CERTIFICATE OF CORRECTION

PATENT NO. : 8,437,949 B2
APPLICATION NO. : 13/070185
DATED : May 7, 2013
INVENTOR(S) : Lesley A. Weitz It is certified that error appears in the above-identified patent and that said Letters Patent is hereby corrected as shown below:

In the Claims

Column 19, Line 16, Claim 7, please replace “level as a” with --level a--.

Signed and Sealed this
Twenty-fifth Day of June, 2013

Teresa Stanek Rea
*Acting Director of the United States Patent and Trademark Office*